US005675980A

United States Patent [19]

Lee

[11] Patent Number: 5,675,980

[45] Date of Patent: Oct. 14, 1997

[54] COOL AIR CIRCULATION DEVICE OF A REFRIGERATOR

[75] Inventor: Sang-Moo Lee, Incheon, Rep. of Korea

[73] Assignee: Daewoo Electronics Co., Ltd., Seoul, Rep. of Korea

[21] Appl. No.: 719,871

[22] Filed: Sep. 25, 1996

[30] Foreign Application Priority Data

Sep. 26, 1995 [KR] Rep. of Korea ..... 95-31765

[51] Int. Cl.[6] ..... F25D 17/08

[52] U.S. Cl. ..... 62/186; 62/426

[58] Field of Search ..... 62/186, 407, 419, 62/426, 440, 441

[56] References Cited

U.S. PATENT DOCUMENTS

| | | | |
|---|---|---|---|
| 2,165,480 | 7/1939 | Hastings | 62/186 |
| 2,321,687 | 6/1943 | Kucher | 62/426 |
| 2,902,840 | 9/1959 | Smith | 62/407 |
| 3,090,209 | 5/1963 | Hubacker | 62/186 |
| 3,107,502 | 10/1963 | Herdon, Jr. et al. | 62/186 |
| 5,315,846 | 5/1994 | Lee | 62/419 |
| 5,495,726 | 3/1996 | Lee | 62/419 |

*Primary Examiner*—William E. Tapolcai

*Attorney, Agent, or Firm*—Beveridge, DeGrandi, Weilacher & Young LLP

[57] ABSTRACT

A cool air circulation device of a refrigerator to forcefully circulate cool air to the fresh food compartment by circulation fan for maximizing a cooling efficiency of the refrigerator is disclosed. A driving motor having belt pully on its shaft is installed in the rear wall of the refrigerator. Controller controls the drive unit to run periodically or continuously, and to stop when opening the door of the refrigerator is provided. Circulation fan having belt pully on its shaft in which the fan rotatably installed in the installation space in the cool air circulation fan accommodation shelf is included. The lower and upper plates of shelf have a number of holes and protect the circulation fan. The rotation of the driving motor is transmitted to the circulation fan by belt.

18 Claims, 2 Drawing Sheets

COOL AIR CIRCULATION DEVICE OF A REFRIGERATOR

BACKGROUND OF THE INVENTION

1. Field of the Invention

The present invention relates to a refrigerator, and more particularly to a cool air circulation device of a refrigerator for circulation of cool air supplied into a fresh food compartment by means of circulation fan, thereby improving a cooling efficiency of refrigerator.

2. Description of the Prior Art

FIG. 1 shows a cross sectional side view of a refrigerator 1 in accordance with the prior art. As shown in the drawing, generally a household refrigerator 1 has an evaporator 40 at the rear of a freezing compartment 10. Low temperature cool air from evaporator 40 is supplied to the freezing compartment 10 or a fresh food compartment 20 by means of fan 15 which is driven by a motor 14. A cool air flow path from main cool air duct 50 in which evaporator 40 is installed is provided, to the freezing compartment 10 and the fresh food compartment 20 for cool air to flow. In front of fan 15, erect isolating plate 11 is installed. In the erect isolating plate 11, a number of cool air supply holes 12 are formed to supply the cool air. Between the freezing compartment 10 and the fresh food compartment 20 are disposed partitions 30, 30. Cool air return ducts 31, 31 are formed in the partitions 30, 30. Refrigerating duct 60 is formed in a rear wall 13 in the rear of motor 14. The refrigerating duct 60 is communicated with upper portion of the fresh food compartment 20. Isolating plate 62 is installed in front of the rear wall 13 of the fresh food compartment 20. A number of cool air supply holes 61 are formed in the isolating plate 62. A number of shelves 63 are inserted in the fresh food compartment 20. A vegetable storage box 64 is installed at the lowermost part of the fresh food compartment 20. A compressor 65 is installed in the lower back portion of the refrigerator 1. In front of the freezing compartment 10 and the fresh food compartment 20, doors 80, 80 are installed, respectively.

The operation of the refrigerator 1 in accordance with the prior art is as follows.

Cool air from evaporator 40 which is installed in the rear of a freezing compartment 10 is supplied to the freezing compartment 10 via cool air supply holes 12 in the erect isolating plate 11. The cool air supplied into the fresh food compartment 20 is returned to a main cool air duct 50 via cool air return duct 31 which is formed in the partition wall 30, 30 installed in the bottom of freezing compartment 10. Cool air is supplied to fresh food compartment 20 via refrigerating duct 60 which is formed in the rear wall 13 of the refrigerator 1 and cool air supply holes 61 of isolating plate 62 in a fresh food compartment 20. Cool air supplied to a fresh food compartment 20 is returned to a main cool air duct 50 via cool air return duct 31 which is formed in the partitions 30, 30.

In the refrigerator 1 in accordance with the prior art as discussed above, especially the cool air supplied to fresh food compartment 20 via refrigerating duct 60 stagnates around cool air supply holes 61. Therefore, temperature difference in the fresh food compartment 20 greatly varies according to location. Because of it the temperature variance refrigerated foods located around cool air supply holes 61 tend to become frozen, and conversely freshness of refrigerated foods located far from cool air supply holes 61 is reduced.

SUMMARY OF THE INVENTION

The present invention is devised to solve the foregoing problems. It is an object of the present invention to provide a cool air circulation device of a refrigerator for the forceful circulation of cool air supplied into a fresh food compartment of the refrigerator by the circulation fan, thereby minimizing deterioration of refrigerated foods.

To achieve the above object of the present invention, there is provided a cool air circulation device of the refrigerator comprising:

- a drive unit having a belt pully on its shaft, and the drive unit is installed in an installation space which is formed in a rear wall of the fresh food compartment of the refrigerator;
- a controller installed in the refrigerator controls a drive unit;
- a cool air circulation device accommodation shelf having an installation space consisting of an upper plate, lower plate and side plates to accommodate the cool air circulation fan therein;
- a circulation fan having a belt pully on its shaft, the circulation fan is rotatably installed in the installation space in the cool air circulation fan accommodation shelf; and
- a belt which transmits rotation of the drive unit to the circulation fan.

The belt is preferably a V-belt and is more preferably a toothed V-belt which has toothed projections on its inner surface to protect against slippage of the belt pullies.

Also, the slant angle of a blade of the circulation fan is preferably small in order to be thin, thereby less volume of the fresh food compartment is required to be utilized, and rear surface of the shelf is preferably spaced apart from the rear wall of the refrigerator to faciliate a flow of cool air.

In the cool air circulation device of the refrigerator according to the present invention constructed as above, the cool air in the fresh food compartment is evenly diffused by the circulation fan, so there is even temperature distribution become even in the fresh food compartment, thereby refrigerated foods can be stored for a long time, minimizing deterioration of the storaging food. The circulation fan can be controlled by controller connected to the drive unit to run periodically or continuously, and can be stopped when opening the door of the fresh food compartment of the refrigerator, thereby minimizing the cool air flow out.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

A cool air circulation device of a refrigerator according to the present invention will be described in detail with reference to FIG. 2.

Figure 1:
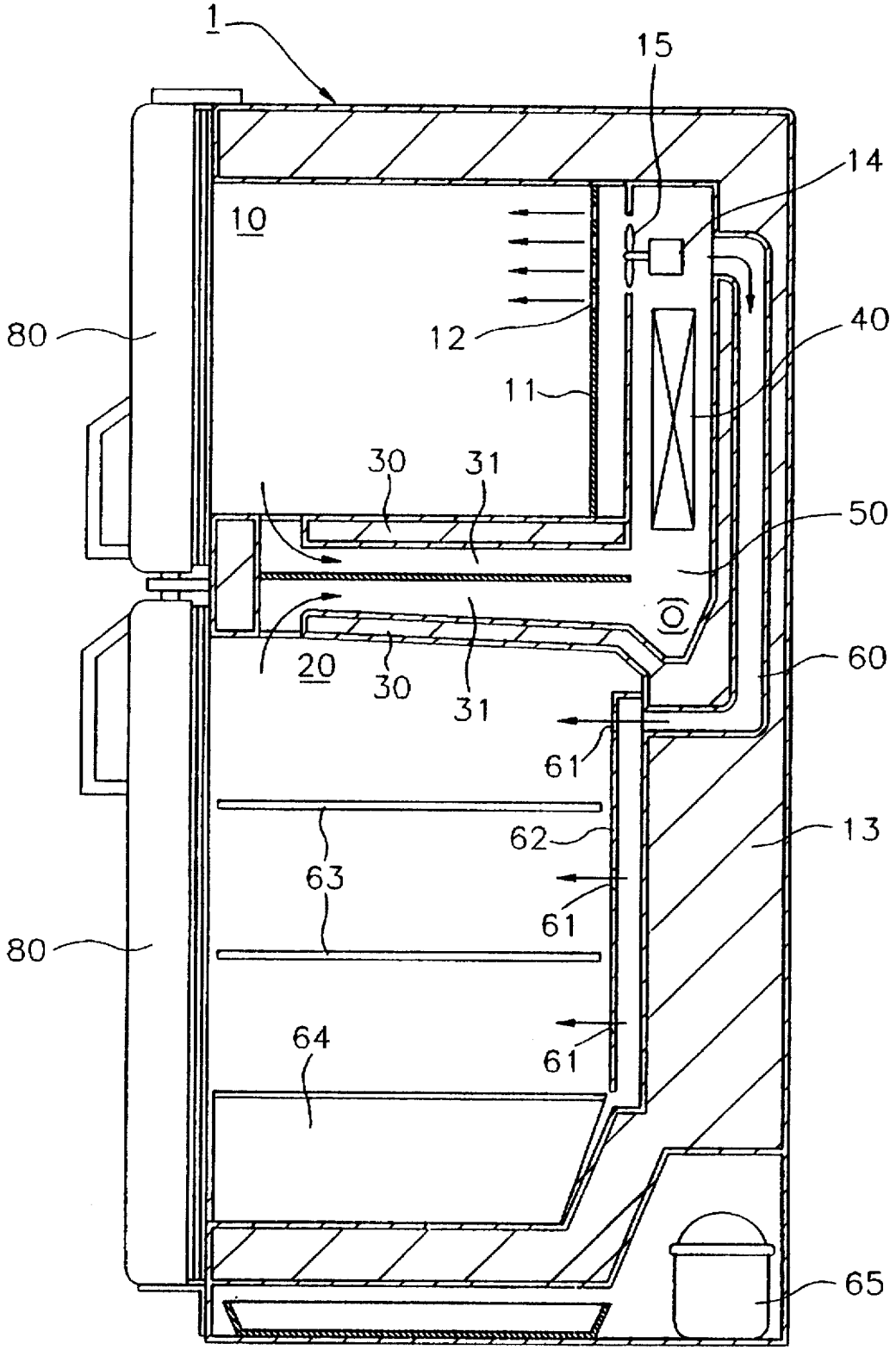
FIG. 1 PRIOR ART
FIG. 1 is a cross sectional side view of a refrigerator according to prior art.
Figure 2:
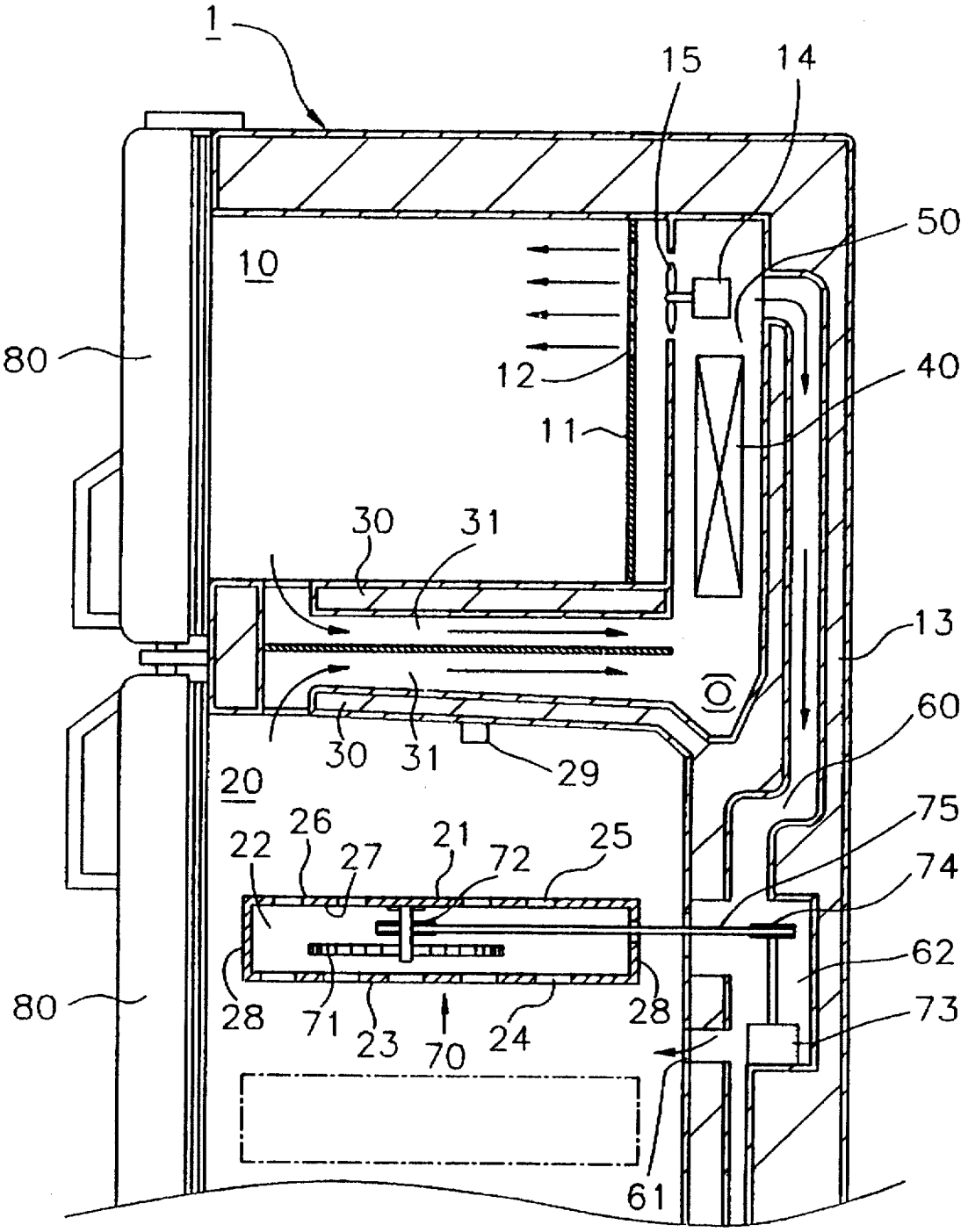
FIG. 2 is a partial cross sectional side view of a refrigerator having cool air circulation fan according to the present invention.

FIG. 2 is a partial cross sectional view of the cool air circulation device 70 of the refrigerator 1 according to the present invention. In the refrigerator 1 as shown in FIG. 2, a shelf 21 is installed by being inserted in both side walls of a refrigerator 1. Shelf 21 has an upper plate 26 and a lower plate 23. The upper plate 26 and lower plate 23 are joined with side plates 28 to form an installation space 22 to accommodate the circulation fan 71 therein. A circulation fan 71 having belt pully 72 is installed at the ceiling of shelf 21 in the installation space 22. By making the blade of the circulation fan 71 at a small slant angle, the overall thickness of the cool air circulation device 70 is reduced.

A number of holes 24 are formed in a lower plate 23 of the shelf 21 for passing cool air therethrough, and the lower plate 23 protects the circulation fan 71. Also, in an upper plate 26 of the shelf 21, there are formed a number of holes 25. A side plate 28 in the rear portion of the shelf 21 is installed spaced apart from rear wall 13 of the refrigerator. Therefore, cool air circulation occurs between an upper space and a lower space of the shelf 21.

The shelf 21 installed circulation fan 71 is firmly inserted in both sides of the refrigerator 1 just above the cool air supply hole 61, in which cool air can easily flow out. A driving motor 73 having a belt pully 74 is installed at the interior of a installation space 62 in the refrigerating duct 60. The belt pully 74 of the driving motor 73 and a belt pully 72 of the circulation fan 71 are connected by a belt 75. The driving motor 73 is an electric motor. The belt is preferably a V-belt, and more preferably a toothed V-belt having projections on its inner surface to protect against slippage.

By connection of a controller 29 such as a micom to a driving motor 73, the driving motor 73 can be controlled periodically or continously, and can be stopped when opening the door of the fresh food compartment of the refrigerator, thereby minimizing cool air flow out.

Meanwhile, it is preferable to increase efficiency of circulation of cool air by installing a cool air supply hole 61 of refrigerating duct 60 which is communicated with the fresh food compartment 20 underneath of the cool air circulation device 70. Also, if necessary, two or more cool air circulation devices can be installed.

The cool air circulation device 70 constructed as described above is only an embodiment of the present invention. Therefore, it can be altered as driving motor 73 and circulation fan are operatively connected by number of gears. Also installation locations and constructions of cool air circulation device 70 can be variously altered without departing from the scope and spirit of the invention.

The cool air circulation device 70 of the refrigerator 1 according to the present invention constructed as above is operated and effected as follows.

Cool air from evaporator 40 which is installed in the rear of the freezing compartment 10 of the refrigerator 1 is supplied into the freezing compartment 10 through cool air supply hole in the erect isolating plate 11. The supplied cool air cools the refrigerated foods in the freezing compartment 10. After a certain period of time, motor 14 and fan 15 operate by controller 29. The previously circulated cool air returns through the cool air return duct 31 formed in the partition 30 which is disposed at bottom of the freezing compartment 10 to the main cool air duct 50. For the cool air supply to the fresh food compartment 20, the cool air from evaporator 40 will be supplied to fresh food compartment 20 via refrigerating duct 60 formed in the rear wall 13 of refrigerator 1 and a cool air supply hole 61 in the fresh food compartment 20 by rotation of the motor 14 and fan 15. Driving motor 73 operates by a signal of controller 29 such as a micom, and the rotation of the driving motor 73 is transferred to the belt pully 72 and circulation fan 71 via belt pully 74 and belt 75. The cool air supplied in the fresh food compartment 20 through the refrigerating duct 60 and cool air supply hole 61 will be circulated downward by the circulation fan 71. Cool air supplied and circulated in the fresh food compartment 20 cools refrigerated foods and is returned to main cool air duct 50 via cool air return duct 31 formed in the partition 30. By doing so, uniform temperature distribution in the fresh food compartment 20 will be accomplished.

As a result, the refrigerator 1 having cool air circulation device 70 according to the present invention can quickly and evenly circulate cool air in the fresh food compartment 20. By doing so, food freshness can be maintained and food can be stored for a long time.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A cool air circulation device of a refrigerator for uniformly circulating cool air in a fresh food compartment supplied via a cool air supply hole, comprising:

a drive means having belt pully on its shaft, said drive means installed in an installation space which is formed in a rear wall of the fresh food compartment of the refrigerator;

a control means installed in the refrigerator to control said drive means;

a cool air circulation device accommodation shelf having an installation space consisting of an upper plate, lower plate and side plates to accommodate a cool air circulation fan therein;

said cool air circulation fan having a belt pully on its shaft, in which said cool air circulation fan is rotatably installed in the installation space in the cool air circulation fan accommodation shelf; and a power transmission means which transmits rotation of the drive means to the cool air circulation fan.

2. The cool air circulation device of a refrigerator as claimed in claim 1, wherein said circulation fan is installed above the cool air supply hole.

3. The cool air circulation device of a refrigerator as claimed in claim 1, wherein said lower plate of the shelf has a number of holes.

4. The cool air circulation device of a refrigerator as claimed in claim 1, wherein said upper plate of the shelf has a number of holes.

5. The cool air circulation device of a refrigerator as claimed in claim 1, wherein said rear part of the shelf is spaced apart from rear wall of the refrigerator.

6. The cool air circulation device of a refrigerator as claimed in claim 1, wherein said power transmission means is a V-belt.

7. The cool air circulation device of a refrigerator as claimed in claim 1, wherein said drive means is an electric motor.

8. The cool air circulation device of a refrigerator as claimed in claim 1, wherein said control means controls the drive means to run periodically or continuously, and to stop when opening the door of the refrigerator.

9. A cool air circulation device of a refrigerator for uniformly circulating cool air in a fresh food compartment supplied via a cool air supply hole comprising:

a drive means having belt pully on its shaft, said drive means installed in a installation space which is formed in a rear wall of the fresh food compartment of the refrigerator;

a control means installed in the refrigerator controls a drive means;

a cool air circulation device accommodation shelf having a installation space consisting of the an upper plate, a lower plate and side plates to accommodate a cool air circulation fan therein, said lower and upper plates having a number of holes;

a circulation fan having belt pully on its shaft, said circulation fan rotatably installed in the installation space in the cool air circulation fan accommodation shelf and istalled above cool air supply hole; and a power transmission means which transmits rotation of the drive means to the circulation fan.

10. The cool air circulation device of a refrigerator as claimed in claim 9, wherein a rear part of the shelf is spaced apart from the rear wall of the refrigerator.

11. The cool air circulation device of a refrigerator as claimed in claim 9, wherein said power transmission means is a V-belt.

12. The cool air circulation device of a refrigerator as claimed in claim 9, wherein said drive means is an electric motor.

13. The cool air circulation device of a refrigerator as claimed in claim 9, wherein said control means controls the drive means to run periodically or continuously, and to stop when opening the door of the refrigerator.

14. A cool air circulation device of a refrigerator for uniformly circulating cool air in the fresh food compartment supplied via a cool air supply hole comprising:

a drive means having belt pully on its shaft, said drive means installed in an installation space which is formed in a rear wall of the fresh food compartment of the refrigerator;

a control means installed in the refrigerator to control the drive means;

a cool air circulation device accommodation shelf having the installation space which consisting of an upper plate, a lower plate and side plates to accommodate the cool air circulation fan therein;

a circulation fan having belt pully on its shaft, said circulation fan rotatably installed in the installation space in the cool air circulation fan accommodation shelf; and a power transmission means which transmits rotation of the drive means to the circulation fan.

15. The cool air circulation device of a refrigerator as claimed in claim 14, wherein said circulation fan installed above the cool air supply hole.

16. The cool air circulation device of a refrigerator as claimed in claim 14, wherein said lower plate of the shelf has a number of holes.

17. The cool air circulation device of a refrigerator as claimed in claim 14, wherein said upper plate of the shelf has number of holes.

18. The cool air circulation device of a refrigerator as claimed in claim 14, wherein said control means controls the drive means to run periodically or continuously, and to stop when opening the door of the refrigerator.

* * * * *